US011131056B2

(12) United States Patent
Lv et al.

(10) Patent No.: US 11,131,056 B2
(45) Date of Patent: Sep. 28, 2021

(54) DRUM WASHING MACHINE

(71) Applicant: QINGDAO HAIER DRUM WASHING MACHINE CO., LTD., Shandong (CN)

(72) Inventors: Yanfen Lv, Shandong (CN); Sheng Xu, Shandong (CN); Yimin Li, Shandong (CN); Yang Li, Shandong (CN)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 91 days.

(21) Appl. No.: 16/612,248

(22) PCT Filed: May 8, 2018

(86) PCT No.: PCT/CN2018/086034
§ 371 (c)(1),
(2) Date: Nov. 8, 2019

(87) PCT Pub. No.: WO2018/205932
PCT Pub. Date: Nov. 15, 2018

(65) Prior Publication Data

US 2021/0156069 A1 May 27, 2021

(30) Foreign Application Priority Data

May 9, 2017 (CN) ..... 201710320201.3

(51) Int. Cl.
*D06F 39/12* (2006.01)
*D06F 39/08* (2006.01)
(Continued)

(52) U.S. Cl.
CPC ..... *D06F 39/12* (2013.01); *D06F 23/025* (2013.01); *D06F 37/266* (2013.01);
(Continued)

(58) Field of Classification Search
CPC ..... D06F 23/025; D06F 37/266; D06F 9/083; D06F 39/12; D06F 39/14
See application file for complete search history.

(56) References Cited

U.S. PATENT DOCUMENTS 2,764,884 A * 10/1956 Constantine ..... D06F 23/025 68/23.4
3,347,065 A * 10/1967 Frances ..... D06F 39/04 68/12.15
(Continued)

FOREIGN PATENT DOCUMENTS

CN 101187130 A 5/2008
CN 103194874 A 7/2013
(Continued)

OTHER PUBLICATIONS

International Search Report (PCT/ISA/210) dated Aug. 10, 2018, by the Chinese Patent Office as the International Searching Authority for International Application No. PCT/CN2018/086034.
(Continued)

*Primary Examiner* — Joseph L. Perrin
(74) *Attorney, Agent, or Firm* — Buchanan Ingersoll & Rooney PC

(57) ABSTRACT

A drum washing machine comprises a body, a door, an inner drum and a drain channel. The drum is rotatably arranged in the body. A delivery port is on a front portion of the drum, and the door is on a front portion of the body corresponding to the delivery port of the drum. A sealing sleeve is arranged on a portion, corresponding to a periphery of the delivery port, of the inner drum. A sealing connecting piece is arranged at a portion, corresponding to a periphery of the door, of the body, and the sealing connecting piece is connected with the sealing sleeve and rotates relative to the drum; and one end of the drain channel extends into the interior of the sealing connecting piece and communicates
(Continued)

with the drum, and the other end of the drain channel communicates with a drain valve.

11 Claims, 4 Drawing Sheets

(51) Int. Cl.
*D06F 23/02* (2006.01)
*D06F 37/26* (2006.01)
*D06F 37/06* (2006.01)

(52) U.S. Cl.
CPC ..... *D06F 39/083* (2013.01); *D06F 23/02* (2013.01); *D06F 37/06* (2013.01)

(56) References Cited

U.S. PATENT DOCUMENTS

| | | | | |
|---|---|---|---|---|
| 3,436,934 | A * | 4/1969 | Stilwell, Jr. | D06F 23/025 68/140 |
| 4,941,333 | A * | 7/1990 | Blessing | D06F 23/025 68/142 |
| 5,979,195 | A * | 11/1999 | Bestell | D06F 37/266 68/139 |
| 9,574,296 | B2 * | 2/2017 | Kim | D06F 37/261 |
| 9,637,855 | B2 * | 5/2017 | Buso | D06F 37/266 |
| 9,644,302 | B2 * | 5/2017 | Kim | D06F 23/025 |
| 2004/0148978 | A1 * | 8/2004 | Kim | D06F 37/267 68/23 A |
| 2006/0174663 | A1 * | 8/2006 | Cimetta | D06F 37/266 68/3 R |
| 2007/0044521 | A1 | 3/2007 | Choi et al. | |
| 2007/0051142 | A1 * | 3/2007 | Lim | D06F 37/266 68/139 |
| 2009/0126418 | A1 * | 5/2009 | Shin | D06F 35/00 68/208 |
| 2016/0258101 | A1 * | 9/2016 | Hake | D06F 58/30 |

FOREIGN PATENT DOCUMENTS

| | | | |
|---|---|---|---|
| CN | 104652091 | A | 5/2015 |
| CN | 106283486 | A | 1/2017 |
| DE | 1610118 | A1 | 4/1971 |
| DE | 19828870 | A1 | 12/1999 |
| GB | 844755 | A | 8/1960 |
| JP | 2012085842 | A | 5/2012 |
| WO | 02/04734 | A1 | 1/2002 |

OTHER PUBLICATIONS

Written Opinion (PCT/ISA/237) dated Aug. 10, 2018, by the Chinese Patent Office as the International Searching Authority for International Application No. PCT/CN2018/086034.

Extended Search Report issued by the European Patent Office in corresponding European Patent Application No. 18797761.6-1016 dated Feb. 26, 2020 (10 pages).

* cited by examiner

DRUM WASHING MACHINE

TECHNICAL FIELD

The present disclosure relates to the technical field of a clothes washing device, in particular to a drum washing machine.

BACKGROUND

In the prior art, a drum washing machine generally comprises an inner drum and an outer drum which are sleeved, the outer drum is sealed and used for containing water, and the inner drum is used for containing clothes and can rotate to beat and wash the clothes. Meanwhile, the inner drum is provided with draining holes, so that water in the outer drum flows into the inner drum through the draining holes to soak the clothes in the inner drum, the water in the inner drum flows out to the outer drum through the draining holes, and water in the clothes in the inner drum is discharged to the outer drum through the draining holes when the inner drum rotates at a high speed, so as to realize the purpose of washing clothes.

However, as the inner drum and the outer drum are mutually sleeved, dirt tends to be accumulated between the inner drum and the outer drum during the use of the washing machine. Besides, because the inner and outer drums are mutually sleeved, users cannot clean the outer wall of the inner drum and the inner wall of the outer drum, thus increasing bacteria in the washing machine and reducing the washing efficiency of the washing machine and the cleanliness of the washed clothes.

Meanwhile, in the existing washing machines, the inner drum is sleeved with the outer drum, the inner drum rotates to beat and wash clothes in the washing process, so the washing capacity of the washing machine is based on the inner drum, resulting in a low utilization rate of the inner space of the washing machine, and the washing capacity of the washing machine cannot be expanded on the existing basis.

In view of this, the current research and development hotspot is to provide a washing machine to combine the inner and outer drum and make the inner drum be a sealed container, which can not only contain water and clothes, but also rotate to beat and wash the clothes. Meanwhile, since the washing machine is not provided with an outer drum or the outer drum and a washing machine housing are integrally arranged, the inner drum of the washing machine can be expanded to improve the washing capacity of the washing machine.

However, since the inner drum not only contains washing water, but also rotates to beat and wash clothes in the drum, how to design a draining structure suitable for the washing machine has become an urgent problem to be solved.

In view of the above technical defects, the present application is hereby submitted.

SUMMARY

In order to solve the above problem, the present disclosure provides a drum washing machine, and in particular adopts the following technical solutions:

A drum washing machine, comprising a body, a door, an inner drum and a drain channel, wherein the inner drum is rotatably arranged in the body, and is configured to hold water during washing;

a delivery port is provided on a front portion of the inner drum for taking out and putting in clothes, and the door is installed on a front portion of the body corresponding to the delivery port of the inner drum for opening or closing the delivery port;

a sealing sleeve is arranged on a portion, corresponding of a periphery of the delivery port, of the inner drum and rotates relative to the inner drum, a sealing connecting piece is arranged at a portion, corresponding to a periphery of the door, of the body, and the sealing connecting piece is sealed connected with the sealing sleeve and rotates relative to the inner drum; and one end of the drain channel extends into an interior of the sealing connecting piece and communicates with the inner drum, and the other end of the drain channel communicates with a drain valve.

Further, the body comprises a front plate, an opening is provided on the front plate corresponding to the delivery port of the inner drum; and the front plate comprises a front lower plate arranged below a lowest point of the opening, and the front lower plate comprises an outer plate and an inner plate, and a hollow interlayer is formed between the inner plate and the outer plate; and a lower part of the sealing connecting piece is sealed installed at an inner side, towards the inner drum, of the inner plate, the drain channel is arranged in the hollow interlayer, and an upper opening of the drain channel extends into the sealing connecting piece.

Further, the sealing connecting piece comprises a sealing connecting ring and an elastic connecting body, the sealing sleeve is provided with an annular sealing groove, the sealing connecting ring is inserted into the annular sealing groove and is sealed connected with the sealing sleeve, the sealing connecting ring is sealed connected to the inner side of the inner plate via the elastic connecting body, and the upper opening of the drain channel in the hollow interlayer extends into the elastic connecting body.

Further, the elastic connecting body comprises an annular body, one end of the annular body is sealed connected with the sealing connecting ring, the other end of the annular body is flanged inwards or outwards, and is in sealed connection with an inner wall of the inner plate, and the upper opening of the drain channel in the hollow interlayer extends into the annular body.

Further, a water collecting device is arranged below a lower opening of the drain channel in the hollow interlayer, and the water collecting device is communicated with the drain valve.

Further, the water collecting device comprises a water collecting groove opening upwardly and a connecting pipe connected with a bottom of the water collecting groove, and the connecting pipe is connected with the drain valve; and the lower opening of the drain channel in the hollow interlayer is arranged correspondingly above the water collecting groove.

Further, an inside wall of the inner drum is provided with a water guiding rib which inclines towards the delivery port, during a drainage, the inner drum rotates, washing water is guided to the delivery port by the water guiding rib, and washing water is discharged through the drain channel in the hollow interlayer.

Further, an installation groove is provided at the periphery of the delivery port of the inner drum, the sealing sleeve is installed in the installation groove in a relatively rotatable manner and is sealed contact with the installation groove, and one end of the sealing connecting piece extends into the installation groove and is sealed connected with the sealing sleeve Further, comprising a driving device, wherein a bottom of the inner drum is in a transmission connection with the driving device via a central rotating shaft, and an interior of the central rotating shaft is hollow for providing a water flow channel for feeding and/or discharging water.

Further, comprising a supporting seat, wherein the supporting seat is installed in the body via a damping device, an accommodation cavity with an opening is provided inside the supporting seat, the bottom of the inner drum is arranged in the accommodation cavity of the supporting seat, and the central rotating shaft is supported on a bottom wall of the supporting seat in a rotatable manner; and a drain outlet is provided on the bottom of the inner drum, the drain outlet is installed with a sealing plug;

a stretchable device is installed at the bottom of the supporting seat corresponding to the sealing plug, the stretchable device stretches out, the sealing plug is pushed out, and the drain outlet is open to discharge water;

the stretchable device pulls back, the sealing plug is reset, and the drain outlet is closed.

The inner drum of the drum washing machine of the present disclosure is a holeless inner drum which is not provided with dehydration holes on a wall of the inner drum. During washing, the inner drum holds washing water, and the inner drum rotates to wash clothes. As to the drum washing machine of the present embodiment, an outer drum is cancelled, in this way, when the size of the body is not changed, the volume of the inner drum is increased, and the volume of a drum washing machine is increased. In addition, the inner drum holding water, the problem that dirt is easily accumulated between an outer wall of the inner drum and an inner wall of the outer drum since washing water of washing machine entering a space between an inner drum and an outer drum is solved.

Since clothes in the existing drum washing machine is washed by being lift/beat during rotation of the inner drum, the outer drum of the existing drum washing machine is mainly configured to hold water, the outer drum is fixed and cannot move, and is easy to be sealed. As to the drum washing machine of the present disclosure, the inner drum is creatively designed to be a holeless inner drum. Since the inner drum is horizontally arranged, in the present disclosure, a sealing sleeve which can rotate relative to an inner drum is arranged on the periphery of the delivery port of the inner drum, and the delivery port of the inner drum and the body at the periphery of the door is sealed connection in a relatively rotatable manner, the sealing of the inner drum is ensured, the function of water holding of the inner drum is realized, simultaneously, washing and dehydration functions with no influence on rotation of the inner drum is realized.

As to the drum washing machine of the present disclosure, in combination with a sealed manner between the inner drum and the body and through setting the interlayer structure on the body below the door, the drain channel is arranged in the interlayer structure to realize drainage, therefore, the drainage manner is simple and reliable, and the manner of arranging an interlayer in the body enables a surface of an inner wall of the body to be flush, and is more beneficial for sealed connection of the delivery port of the inner drum.

Figure 1:
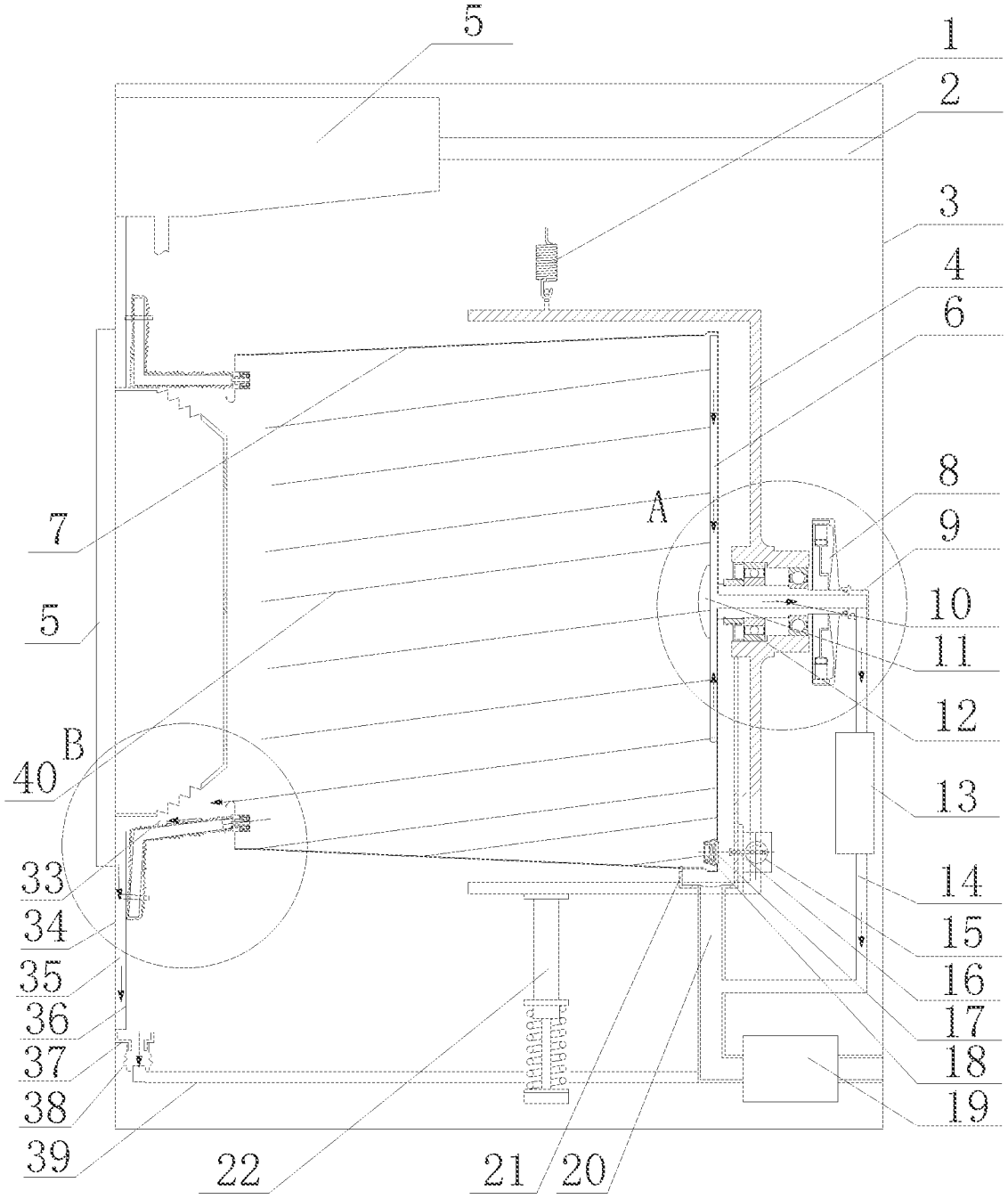
FIG. 1 is a front view of the drum washing machine of an embodiment of the present disclosure.

Reference numerals in the figures: 1—damping hanging spring 2—water inlet pipe 3—body 4—supporting seat 5—door 6—water collecting flow channel 7—inner drum 8—driving device 9—communicating piece 10—central rotating shaft 11—water collecting chamber 12—bearing 13—self-priming pump 14—drain pipe 15—eccentric cam 16—stretchable rod 17—sealing plug 18—reset spring 19—drain valve 20—main drain pipe 21—water retaining rib 22—damper 23—rolling device 24—sealing sleeve 25—sealing connecting ring 26—elastic connecting body 27—connecting piece 28—groove sealing sleeve 29—drain outlet 30—positioning locking hole 31—positioning locking device 32—installation groove 33—interval 34—outer plate 35—drain channel 36—inner plate 37—water collecting groove 38—connecting hose 39—connecting pipe 40—water guiding rib.

DETAILED DESCRIPTION

A brief description will be given to the drum washing machine of the present disclosure in combination with accompanying drawings:

Embodiment 1

Figure 2:
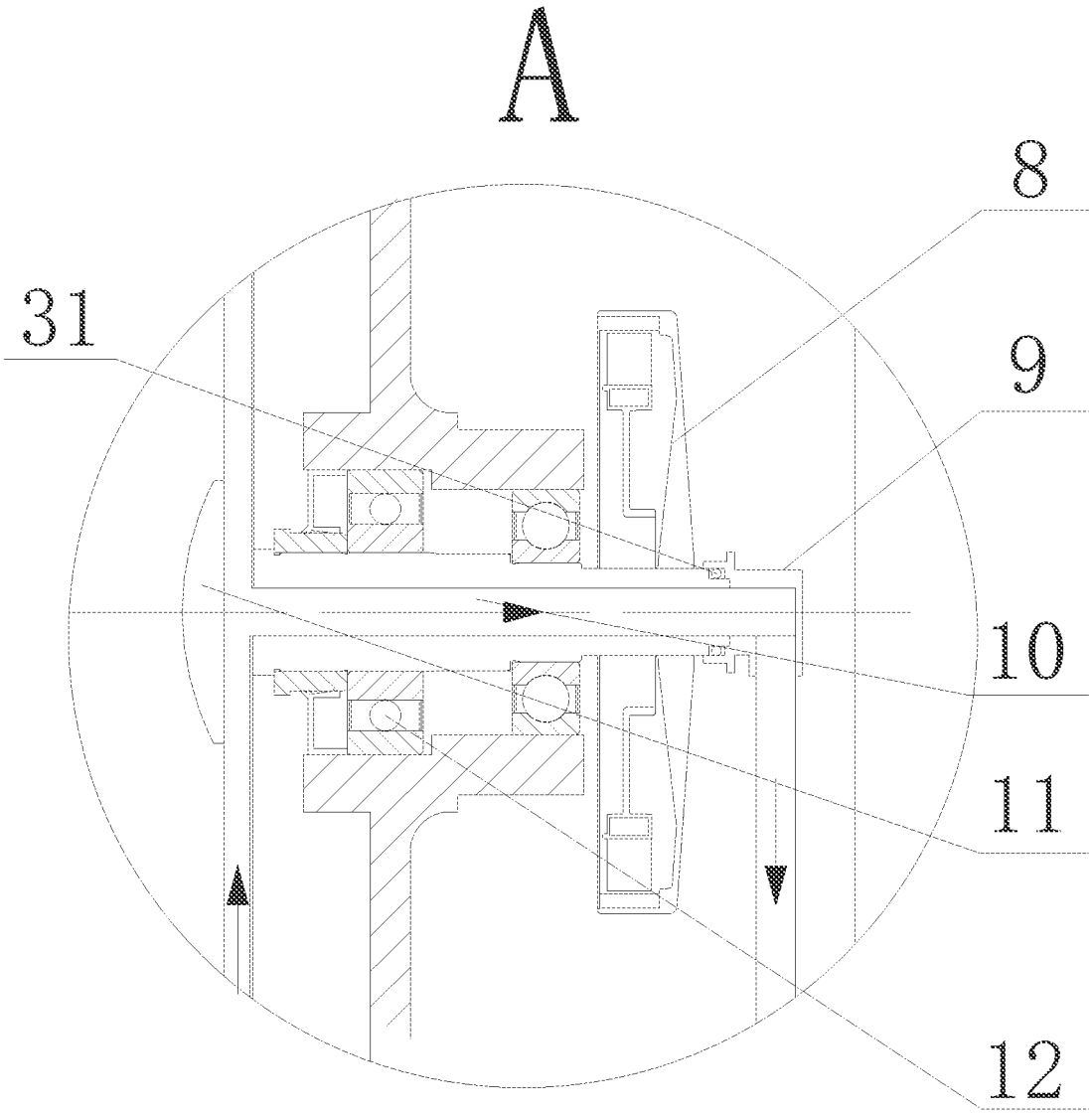
FIG. 2 is a partially enlarged view of A in FIG. 1.
Figure 3:
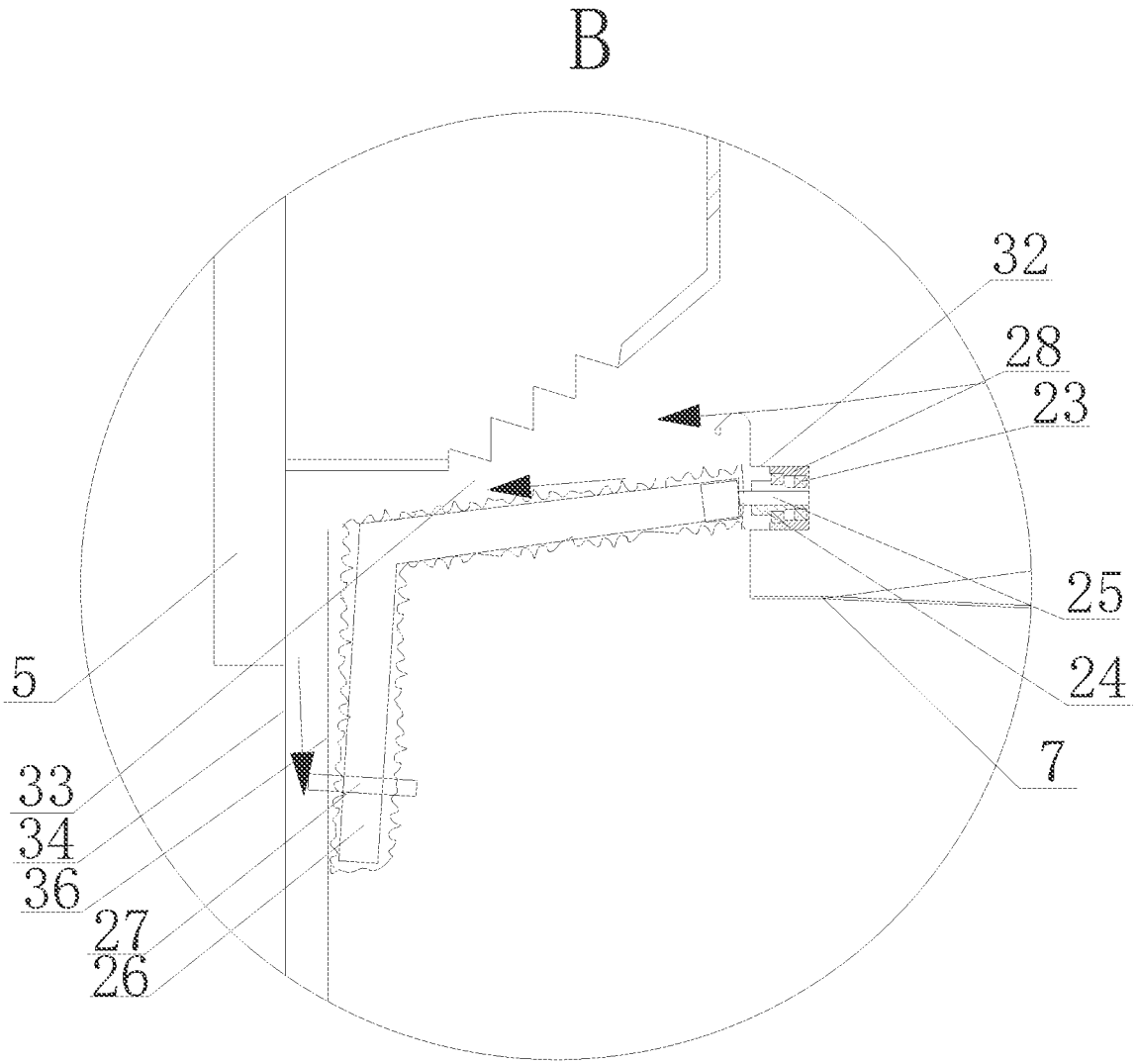
FIG. 3 is a partially enlarged view of B in FIG. 1.
Figure 4:
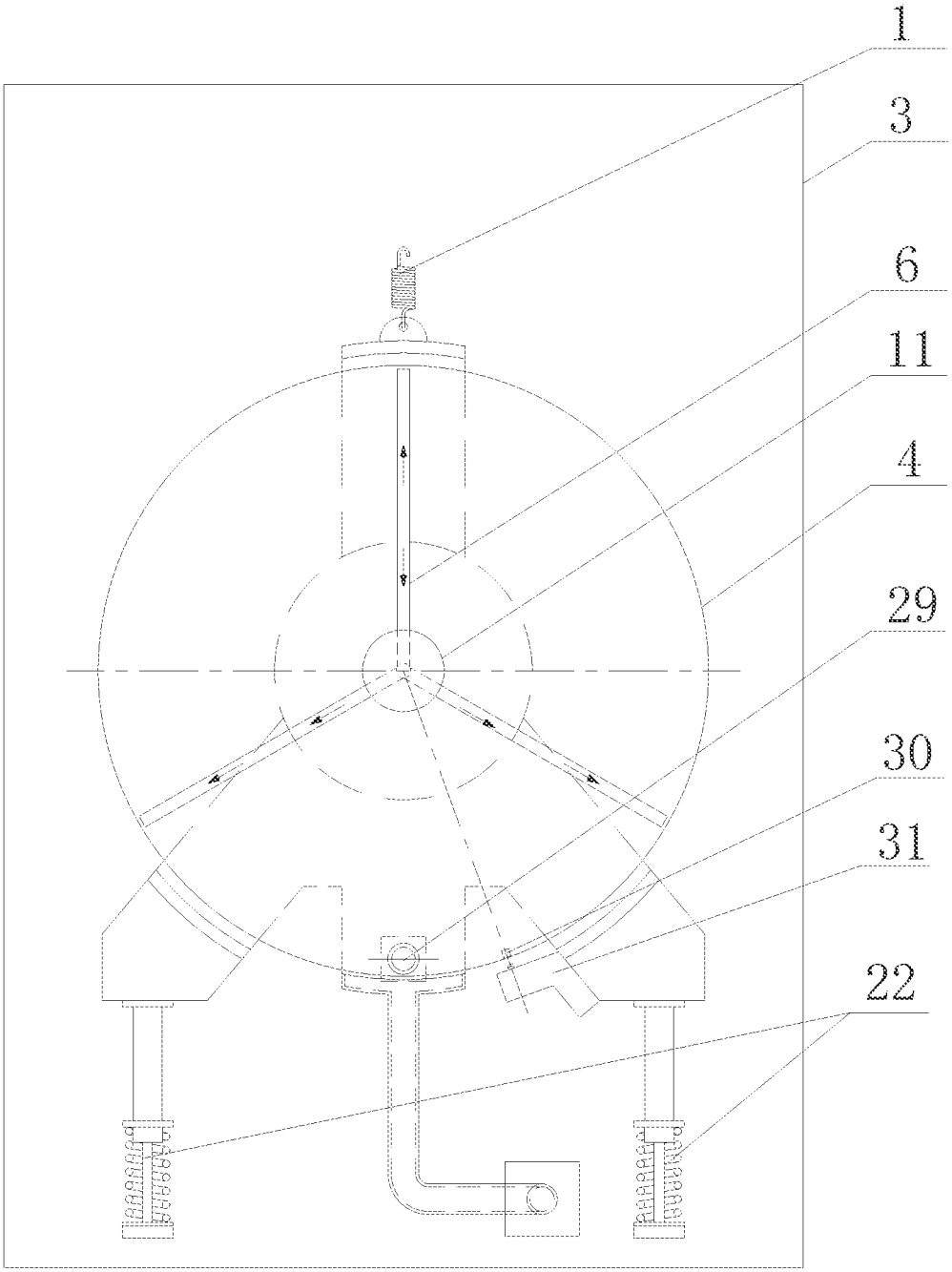
FIG. 4 is a left view of the drum washing machine of an embodiment of the present disclosure.

As shown in FIG. 1, FIG. 2, FIG. 3 and FIG. 4, a drum washing machine is provided, comprising a body 3, a door 5, an inner drum 7, the inner drum 3 is rotatably arranged in the body 3, and is configured to hold water during washing; a delivery port is provided on the front of the inner drum for taking out and putting in clothes, and the door 5 is installed on a front portion the body 3 corresponding to the delivery port of the inner drum 7 for opening or closing the delivery port; the delivery port of the inner drum 7 and the body 3 at the periphery of the door 5 is sealed connection in a relatively rotatable manner.

The inner drum 7 of the drum washing machine of the present embodiment is a holeless inner drum which is not provided with dehydration holes on a wall of the inner drum. During washing, the inner drum 7 holds washing water, and the inner drum 7 rotates to wash clothes. As to the drum washing machine of the present embodiment, an outer drum is cancelled, in this way, when the size of the body is not changed, the volume of the inner drum 7 is increased, and the volume of a drum washing machine is increased. In addition, the inner drum 7 holding water, the problem that dirt is easily accumulated between an outer wall of an inner drum and an inner wall of an outer drum since washing water of existing washing machine entering a space between an inner drum and an outer drum is solved.

Since clothes in the existing drum washing machine is washed by being lift/beat during rotation of the inner drum, the outer drum of the existing drum washing machine is mainly configured to hold water, the outer drum is fixed and cannot move, and is easy to be sealed. As to the drum washing machine of the present disclosure, the inner drum 7 is creatively designed to be a holeless inner drum. Since the inner drum 7 is horizontally arranged, in the present disclosure, a sealing sleeve 25 which can rotate relative to the inner drum 7 is arranged on the periphery of the delivery port of the inner drum 7, and the delivery port of the inner drum 7 and the body 3 at the periphery of the door 5 is sealed connection in a relatively rotatable manner, the sealing of the inner drum 7 is ensured, the function of water holding of the inner drum 7 is realized, simultaneously, washing and dehydration functions with no influence on rotation of the inner drum is realized.

As to realize the sealing connection in a relatively rotatable manner between the delivery port of the inner drum 7 and the body 3 at the periphery of the door 5, a sealing sleeve 24 is arranged at a periphery of the delivery port and rotates relative to the inner drum 7, a sealing connecting piece is arranged at a portion, corresponding to a periphery of the door 5, of the body 3, the sealing connecting piece is sealed connected with the sealing sleeve and rotates relative to the inner drum 7.

This embodiment realizes the seal via the coordination between the sealing connecting piece arranged at a portion of the body 3 corresponding to a periphery of the door 5 and the sealing sleeve 24 in an installation groove on the inner drum 7. No matter the door 5 opens or closes, the seal between the delivery port and the door 5 is always kept. The structure is simple, and it is not affected by the opening or closing state of the door 5.

Further, an installation groove 32 is provided on a portion, at the periphery of the delivery port, of the inner drum 7, the sealing sleeve 24 is installed in the installation groove 32 in a relatively rotatable manner and sealed contact with the installation groove 32, and one end of the sealing connecting piece extends into the installation groove 32 and is integrated with the sealing sleeve 24 in a sealed manner.

In order to realize the relative rotation between the sealing sleeve 24 and the inner drum 7 and not affect the washing and dehydration during the inner drum 7 rotating, a rolling device 23 is arranged in the installation groove 32, and the rolling device 23 is sealed in contact with the sealing sleeve 24 and the installation groove 32 respectively. The sealing sleeve 24 and the installation groove 32 are relatively rotated via the rolling device 23. Specifically, the rolling device can adopt ball, etc.

Since the rolling device 23 needs to be in sealed contact with the installation groove 32, a groove seal sleeve 28 is provided in the installation groove 32, a outer ring of the groove seal sleeve 28 is in sealed contact with an inner wall of the installation groove 32, and an inner ring of the groove seal sleeve 28 is in sealed contact with the rolling device 23.

As a preferred embodiment of the invention, the sealing connecting piece comprises a sealing connecting ring 25 which is a circular annular, the sealing sleeve 24 is provided with an annular sealing groove, and the sealing connecting ring 25 is inserted into the annular sealing groove and is integrated with the sealing sleeve 24 in a sealed manner.

Further preferably, the sealing connecting ring 25 defined in this embodiment is sealed on an inner wall of the body 3 via a elastic connecting body 26 made of elastic material for buffeting the vibration of the body 3 driven by the inner drum 7. Because during drum washing machine working, the inner drum 7 is inevitable shaking or vibration, connect the sealing ring 25 is installed on an inner side of the door 5 via the elastic connecting body 26, such as the sealing connecting ring 25 is inserted into the annular seal groove and integrated with the sealing sleeve 24 in a sealed manner, equal to the connection between the body 3 and the inner drum 7 is elastic, the buffering and damping of the inner drum 7 is effective, which improve the stability of the inner drum 7.

Specifically, the elastic connecting body 26 comprises an annular body, one end of the annular body is in sealed connection with the sealing connecting ring 25, and the other end of the annular body is flanged inwards/outwards and is in sealed connection with an inner wall of the body 3.

Specifically, a flanging of the elastic connecting body 26 in this embodiment is sealed to the body 3 via a connecting piece 27; the connecting piece 27 is a bolt or screw.

The drum washing machine in this embodiment simultaneously solves the problem of water entering and drainage, and the specific scheme is as follows:

The drum washing machine further comprising a driving device 8, a bottom of the inner drum 7 is in transmission connection with the driving device 8 via a central rotating shaft 10, and an interior of the central rotating shaft 10 is hollow for setting a water flow channel for water entering and/or discharge.

In this embodiment, the water flow channel is set within the central rotating shaft 10, so that the water entering or drainage of the washing machine can enter and drain out through the water flow channel, and the rotation of the inner drum will not affect the water entering or drainage.

Preferably, a water flow channel is set within the central rotating shaft 10 of this embodiment, and the water flow channel is connected with an inlet device or a drainage device of the drum washing machine, while the water flow channel within the central rotating shaft 10 of this embodiment can only realize the separate inlet or drainage function.

Alternatively, a plurality of water flow channels connected with inlet device and drainage device are arranged within the central rotating shaft 10 mentioned in this embodiment, so that the water flow channel within the central rotating shaft 10 can realize inlet and drainage at the same time.

As a preferred implementation mode of the present disclosure, one end of the center rotating shaft 10 extends out of the driving device 8. The extending end of the center rotating shaft 10 is rotatably mounted on a communicating piece 9 through a bearing 31. A communicating channel is provided in the communicating piece 9, and enables the water flow channel to communicate with the water entering device/drainage device.

The present disclosure elaborates by taking drainage realized through the water flow channel in the center rotating shaft 10 as an example. The water flow channel in the center rotating shaft 10 in the present embodiment communicates with the drainage device to realize the drainage function. Specifically, the drainage device in the present embodiment includes a drain pipe 14 and a self-priming pump 13. A water inlet of the self-priming pump 13 communicates with the water flow channel in the center rotating shaft through the drain pipe 14.

Since the center rotating shaft 10 is located at the center position of the bottom of the inner drum 7, instead of the lowest position of the drum, in order to ensure that the washing water in the inner drum 7 is drained better, the inner wall of the bottom of the inner drum 7 is provided with a water collection device for collecting water in a dewatering and/or drainage process, and the water collection device communicates with the water flow channel. In the dewatering and/or drainage process, the water collection device collects the water in the drum and drains the water under the suction action of the self-priming pump 13.

Specifically, the water collection device of the present embodiment is provided with a water collecting chamber 11 and a water collecting flow channel 6. The water collecting chamber 11 is arranged in the center of the inner wall of the bottom of the inner drum 7, and communicates with the water flow channel in the center rotating shaft 10. The water collecting flow channel 6 are arranged on the inner wall of the bottom of the inner drum 7. One end of the water collecting flow channel 6 communicate with the water collecting chamber 11, and the other end of the water collecting flow channel 6 extend towards the inner wall of the inner drum 7.

Preferably, a plurality of water collecting flow channel 6 is arranged and are uniformly distributed in the circumferential direction of the bottom of the inner drum 7, respectively.

In order to cooperate with the water collection device to collect water, the end, opposite to the bottom, on the inner drum 7 in the present embodiment is provided with a front drum cover. The diameter of the front drum cover is less than the diameter of the bottom of the inner drum 7. The side wall of the inner drum 7 is upwards inclined from the front drum cover to the bottom.

In order to achieve a water collection effect of the water collection device, rotation of the inner drum 7 is also needed. When the inner drum 7 rotates, the washing water is gathered on the surface of the side wall of the inner drum 7 under the centrifugal action. Due to the inclined structure of the side wall of the inner drum 7, the washing water is gathered from the front drum cover to the bottom along the inclined side wall of the inner drum 7 and guided into the water collecting chamber 11 through the water collecting flow channel 6 arranged here.

Therefore, the drum washing machine of the present embodiment realizes water collection and drainage in the dewatering process by virtue of the high-speed rotation of the inner drum 7. A drainage procedure may be added after the washing process. The drainage is realized by accelerating the high-speed rotation of the inner drum 7.

As a preferred implementation mode of the present embodiment, the water collection device of the present embodiment includes a cover plate mounted on the inner wall of the bottom of the inner drum 7. The cover plate is internally provided with a closed hollow cavity to form the water collecting chamber 11 and the water collecting flow channel 6. Or, the cover plate is internally provided with an open groove. The cover plate and the inner wall of the bottom of the drum are hermetically connected to close the groove to form the water collecting chamber 11 and the water collecting flow channel 6.

As a preferred implementation mode of the present embodiment, a protruding structure protruding from the inner bottom of the drum is constructed on the upper surface of the water collection device. The protruding structure may lift washings during washing, so as to enhance a washing effect.

A drum washing machine of the present embodiment further includes a supporting seat 4, wherein the supporting seat 4 is installed in the body 3 via a damping device, the supporting seat 4 is internally provided with an accommodation cavity which is open, a bottom of the inner drum 7 is arranged in an accommodation cavity of the supporting seat 4, and the central rotating shaft 10 can be supported on a bottom wall of the supporting seat in a rotatable manner.

The supporting seat 4 of the present embodiment mainly plays a role of supporting and damping the inner drum 7, thereby ensuring working stability of the drum washing machine. Therefore, an opening of the supporting seat 4 can be suspended, with no need of being in sealed connection with the body 3. The supporting seat 4 at least includes a bottom wall configured to support the central rotating shaft 10, and the length of the side wall can be shortened or even can be zero. Specifically, the supporting seat 4 of the present embodiment is preferably of a basin structure.

Further, the damping device in the present embodiment includes a damper 22 and a damping hanging spring 1, the damper 22 is installed in a middle part of a lower side wall of the supporting seat 4, and the damping hanging spring 1 is hung on a top side wall of the supporting seat 4.

Preferably, the damping hanging spring 1 is hung on an end, close to a driving device, of the top side wall of the supporting seat 4, and two dampers 22 are provided and are symmetrically installed at two sides of lower side wall of the supporting seat 4.

As a preferred embodiment of the present embodiment, since the drainage manner of the above central rotating shaft 10 needs to be realized in coordination with high-speed rotation of the inner drum 7, in the present embodiment, on the basis of arranging the supporting seat 4, aiming at drainage of a washing process, a corresponding drainage structure is set.

Specifically, the bottom of the inner drum 7 is provided with a drain outlet 29, the drain outlet 29 is installed with a sealing plug 17; a stretchable device is installed at a portion, corresponding to the sealing plug 17, of the bottom of the supporting seat 4, the drain outlet 29 is open to discharge water when the sealing plug 17 is pushed out by stretching out of the stretchable device; the drain outlet 29 is closed when the sealing plug 17 is reset by retracting of the stretchable device.

Therefore, as to the drum washing machine of the present embodiment, drainage in a washing process can be realized through controlling the stretchable device to open the drain outlet 29. In a drainage process, water can be discharged through a water flow channel inside the central rotating shaft 10.

Further, the drain outlet 29 of the present embodiment is further internally provided with a reset spring 18 which is connected with the sealing plug 17, the stretchable device is retracted, and the sealing plug 17 is reset under an elastic effect of the reset spring 18.

A stretchable device of the present embodiment includes an eccentric cam 15 which is rotated under the drive of a motor and a stretchable rod 16 which is in rotatable connection with the eccentric cam 15, and the eccentric cam 15 rotates to drive the stretchable rod 16 to move upwards, so as to push the sealing plug 17 to open the drain outlet 29 to discharge water.

An outer drum drain outlet is arranged on a portion, corresponding to the drain outlet 29 of the inner drum 7, of the supporting seat 4 of the present embodiment, the outer drum drain outlet is connected with a drain pipe 20, one side of the outer drum drain outlet is provided with a water retaining rib 21, and the water retaining rib 21 blocks washing water between the water retaining rib 21 and the supporting seat 4, thereby avoiding too much contact between washing water and an inner surface of the supporting seat 4, and avoiding accumulation of dirt on an inner wall of the supporting seat 4.

A drain pipe 14 of the present embodiment is communicated with a main drain pipe 20, and the main drain pipe 20 is connected with a drain valve 19.

In order to realize corresponding match between the stretchable device and the sealing plug 17, a side wall of the supporting seat 4 is installed with a positioning locking device 31, a side wall of the inner drum 7 is provided with a positioning locking hole 30 which is in match with the positioning locking device 31, and the positioning locking device 31 is in match with the positioning locking hole 30 to lock, to limit rotation of the inner drum 7 relative to the supporting seat 4. In the present embodiment, through matched locking between the locking device 31 and the locking hole 30, the inner drum 7 is locked, and the stretchable device is just opposite to the sealing plug 17, thereby better realizing control of water discharge of the sealing plug 17.

Embodiment 2

As shown in FIG. 1, FIG. 2, FIG. 3 and FIG. 4, a drum washing machine, comprising a body 3, a door 5, an inner drum 7 and a drain channel 35, the inner drum 7 is rotatably arranged in the body 3, and is configured to hold water during washing; a delivery port is provided on the front of the inner drum 7 for taking out and putting in clothes, and the door 5 is installed on a front portion of the body 3 corresponding to the delivery port of the inner drum 7 for opening or closing the delivery port; a sealing sleeve 24 is arranged at a periphery of the delivery port and rotates relative to the inner drum 7, a sealing connecting piece is arranged at a portion, corresponding to a periphery of the door 5, of the body 3, and the sealing connecting piece is sealed connected with the sealing sleeve 24 and rotates relative to the inner drum 7; and one end of the drain channel 35 extends into the interior of the sealing connecting piece and communicates with the inner drum 7, and the other end of the drain channel 35 communicates with a drain valve 19.

In the present embodiment, the drain channel 35 is inserted into a sealing connecting piece to be communicated with the inner drum 7, and washing water is controlled to discharge from the drain channel 35 through controlling opening and closing of the drain valve 19.

Further, the body 3 of the present embodiment includes a front plate, a opening is provided on a portion, corresponding to the delivery port of the inner drum, of the front plate; and the front plate comprises a front lower plate arranged below a lowest point of the opening, and the front lower plate comprises an outer plate 34 and an inner plate 36, and a hollow interlayer is formed between the inner plate 36 and the outer plate 34; and a lower part of the sealing connecting piece is sealed installed at an inner side, towards the inner drum 7, of the inner plate 36, the drain channel 35 is arranged in the hollow interlayer, and an upper opening of the drain channel 35 extends into the sealing connecting piece.

In the present embodiment, the hollow interlayer is arranged on the body 3 to set the drain channel 35, therefore, the drain channel 35 extends into the interior of the sealing connecting piece more easily, and sealed connection between the sealing connecting piece and the body 3 is kept.

An interval 33 is formed between the sealing connecting piece and the door 5 of the present embodiment, in this way, the drain channel 35 is ensured to extend into the interior of the sealing connecting piece, and washing water flows into the drain channel 35 from the interval 33.

The sealing connecting piece of the present embodiment comprises a sealing connecting ring 25 and an elastic connecting body 26, the sealing sleeve 24 is provided with an annular sealing groove, the circular sealing connecting ring 25 is inserted into the annular sealing groove and is integrated with the sealing sleeve 24 in a sealed manner, the sealing connecting ring 25 is connected to the inner side of the inner plate 36 in a sealed manner via the elastic connecting body 26, and the upper opening of the drain channel 35 in the hollow interlayer extends into the elastic connecting body 26.

Further, the elastic connecting body 26 of the present embodiment includes an annular body, one end of the annular body is in sealed connection with the sealing connecting ring 25, the other end of the annular body is flanged inwards/outwards and is in sealed connection with an inner wall of the inner plate 36, and the upper opening of the drain channel 35 in the hollow interlayer extends into the annular body.

As a preferred embodiment of the present embodiment, a water collecting device is arranged below a lower opening of the drain channel 35 in the hollow interlayer, and the water collecting device is communicated with the drain valve 19.

Specifically, the water collecting device includes a water collecting groove 37 opening upwardly and a connecting pipe 39 connected with a bottom of the water collecting groove 37, and the connecting pipe 39 is connected with the drain valve 19; and the lower opening of the drain channel 35 in the hollow interlayer is arranged correspondingly above the top opening of the water collecting groove 37.

In the present embodiment, the connecting pipe 39 is connected with the water collecting groove 37 via a connecting hose 38, thereby buffering relative movement between the water collecting groove 37 and the connecting pipe 39 caused by vibration of the drum washing machine.

In order to better discharge washing water from the drain channel 35 at a front end, an inner sidewall of the inner drum 7 of the present embodiment is provided with a water guiding rib 40 which inclines towards the delivery port, during drainage, the inner drum rotates, washing water is guided to the delivery port by the water guiding rib 40, and washing water is discharged through the drain channel 35 in the hollow interlayer.

An installation groove 32 is provided a portion, at the periphery of the delivery port, of the inner drum 7 in the present embodiment, the sealing sleeve 24 is installed in the installation groove 32 in a relatively rotatable manner and keeps sealed contact with the installation groove 32, and one end of the sealing connecting piece extends into the installation groove 32 and is integrated with the sealing sleeve 24 in a sealed manner.

As to the drum washing machine of the present embodiment, in combination with a sealed manner between the inner drum 7 and the body 3 and through setting the interlayer structure arranged on the body 3 below the door 5, the drain channel 35 is arranged in the interlayer structure to realize drainage, therefore, the drainage manner is simple and reliable, the manner of arranging an interlayer in the body 3 enables a surface of an inner wall of the body to be flush, and is more beneficial for sealed connection of the delivery port of the inner drum 7.

What is described above is merely the preferred embodiments of the present disclosure, rather than limiting the present disclosure in any form, although the present disclosure has been disclosed above with the preferred embodiments, the preferred embodiments are not used for limiting the present disclosure, those skilled in the art can make some changes or modify into equivalent embodiments with equal changes by utilizing the above suggested technical contents without departing from the scope of the technical solution of the present disclosure, and the contents not departing from the technical solution of the present disclosure, any simple amendments, equivalent changes or modifications made to the above embodiments based on the technical essence of the present disclosure shall all fall within the scope of the solution of the present disclosure.

The invention claimed is:

1. A drum washing machine, comprising:

a body;

a door;

an inner drum;

a drain channel, wherein the inner drum is rotatably arranged in the body, and is configured to hold water during washing, a delivery port is provided on a front portion of the inner drum for taking out and putting in clothes, and the door is installed on a front portion of the body corresponding to the delivery port of the inner drum for opening or closing the delivery port;

the body includes a front plate, an opening is provided on the front plate corresponding to the delivery port of the inner drum, the front plate includes a front lower plate arranged below a lowest point of the opening, and the front lower plate includes an outer plate, an inner plate, and a hollow interlayer formed between the inner plate and the outer plate;

a sealing sleeve is arranged on a portion, corresponding of a periphery of the delivery port, of the inner drum; and a sealing connecting piece is arranged at a portion, corresponding to a periphery of the door, of the body, a lower part of the sealing connecting piece is sealably installed at an inner side, towards the inner drum, of the inner plate, the sealing connecting piece is in sealed connection with the sealing sleeve, and the inner drum is configured to rotate relative to the sealing sleeve and the sealing connecting piece, and the drain channel is arranged through the hollow interlayer, and one end of the drain channel extends into an interior of the sealing connecting piece and communicates with the inner drum, and the other end of the drain channel communicates with a drain valve.

2. The drum washing machine according to claim 1, wherein the sealing connecting piece comprises a sealing connecting ring and an elastic connecting body, the sealing sleeve is provided with an annular sealing groove, the sealing connecting ring is inserted into the annular sealing groove and is in sealed connection with the sealing sleeve, the sealing connecting ring is in sealed connection to the inner side of the inner plate via the elastic connecting body, and the upper opening of the drain channel through the hollow interlayer extends into the elastic connecting body.

3. The drum washing machine according to claim 2, wherein the elastic connecting body comprises an annular body, one end of the annular body is in sealed connection with the sealing connecting ring, the other end of the annular body is flanged inwards or outwards, and is in sealed connection with an inner wall of the inner plate, and the upper opening of the drain channel through the hollow interlayer extends into the annular body.

4. The drum washing machine according to claim 3, wherein a water collecting device is arranged below a lower opening of the drain channel through the hollow interlayer, and the water collecting device is in communication with the drain valve.

5. The drum washing machine according to claim 2, wherein a water collecting device is arranged below a lower opening of the drain channel through the hollow interlayer, and the water collecting device communicates with the drain valve.

6. The drum washing machine according to claim 1, wherein a water collecting device is arranged below a lower opening of the drain channel through the hollow interlayer, and the water collecting device is communicated with the drain valve.

7. The drum washing machine according to claim 6, wherein the water collecting device comprises a water collecting groove opening upwardly and a connecting pipe connected with a bottom of the water collecting groove, and the connecting pipe is connected with the drain valve; and the lower opening of the drain channel through the hollow interlayer is arranged correspondingly above the water collecting groove.

8. The drum washing machine according to claim 1, wherein an inner sidewall of the inner drum is provided with a water guiding rib which inclines towards the delivery port, and configured so that during a drainage, when the inner drum rotates, washing water is guided to the delivery port by the water guiding rib, and washing water is discharged through the drain channel through the hollow interlayer.

9. The drum washing machine according to claim 1, wherein an installation groove is provided at the periphery of the delivery port of the inner drum, the sealing sleeve is installed in the installation groove and is in sealed contact with the installation groove, and one end of the sealing connecting piece extends into the installation groove and is in sealed connection with the sealing sleeve.

10. The drum washing machine according to claim 1, comprising:

a driving device, wherein a bottom of the inner drum is in a transmission connection with the driving device via a central rotating shaft, and an interior of the central rotating shaft is hollow for providing a water flow channel for feeding and/or discharging water.

11. The drum washing machine according to claim 10, further comprising:

a supporting seat installed in the body via a damping device, an accommodation cavity with an opening is formed inside the supporting seat, wherein the bottom of the inner drum is arranged in the accommodation cavity of the supporting seat, and the central rotating shaft is supported on a bottom wall of the supporting seat in a rotatable manner;

a drain outlet is provided on the bottom of the inner drum, the drain outlet including a sealing plug;

a stretchable device is installed at the bottom of the supporting seat corresponding to the sealing plug, the stretchable device is configured so that when the stretchable device stretches out, the sealing plug is pushed out, and the drain outlet is open to discharge water and when the stretchable device pulls back, the sealing plug is reset, and the drain outlet is closed.

* * * * *